US005996164A

United States Patent [19]

Demetriades

[11] Patent Number: 5,996,164

[45] Date of Patent: Dec. 7, 1999

[54] LIQUID POLISH APPLICATOR AND METHOD OF MAKING SAME

[76] Inventor: Peter G. Demetriades, 2118 Coleman Pl., Henderson, N.C. 27536

[21] Appl. No.: 08/940,782

[22] Filed: Sep. 30, 1997

Related U.S. Application Data

[63] Continuation-in-part of application No. 08/719,095, Sep. 24, 1996.

[51] Int. Cl.[6] ..... A47L 13/20

[52] U.S. Cl. ..... 15/229.1; 15/229.2; 15/229.4; 15/229.8; 300/21

[58] Field of Search ..... 15/228, 229.1–229.9; 300/21

[56] References Cited

U.S. PATENT DOCUMENTS

| | | | |
|---|---|---|---|
| 1,510,505 | 10/1924 | Severns | 300/21 |
| 2,238,432 | 4/1941 | Myers | 15/229.2 X |
| 2,703,425 | 3/1955 | Podolak et al. | 300/21 X |
| 3,246,356 | 4/1966 | Sorrells | 15/229.2 X |
| 3,324,497 | 6/1967 | Moss | 15/229.2 |
| 3,336,620 | 8/1967 | Moss | 300/21 X |
| 3,425,085 | 2/1969 | Moss | 300/21 X |
| 3,449,784 | 6/1969 | Moss | 300/21 X |
| 3,520,017 | 7/1970 | Moss | 15/229.1 |
| 3,633,975 | 1/1972 | Argeris | 15/229.1 X |
| 3,696,460 | 10/1972 | Moss | 15/229.1 |
| 3,822,435 | 7/1974 | Moss | 15/229.8 |
| 3,962,743 | 6/1976 | Moss | 15/229.4 |
| 4,085,476 | 4/1978 | Moss | 15/229.2 |
| 4,717,616 | 1/1988 | Harmon et al. | 15/229.1 X |

FOREIGN PATENT DOCUMENTS

| | | | |
|---|---|---|---|
| 1434415 | 5/1976 | Canada | 300/21 |

*Primary Examiner*—Mark Spisich
*Attorney, Agent, or Firm*—Lalos & Keegan

[57] ABSTRACT

An article for applying a liquid composition on a hard surface which may be allowed to dry and then be buffed to provide a lustrous finish generally comprising a handle, an applicator comprising an initially provided single strand of at least one continuous filament disposed in a winding pattern, providing a plurality of segments disposed in side-by-side relation having severed looped end portions providing free, loose end portions and devices for securing such segments together, and devices for securing such applicator to the handle.

45 Claims, 3 Drawing Sheets

LIQUID POLISH APPLICATOR AND METHOD OF MAKING SAME

This is a continuation-in-part of application Ser. No. 08/719,095, filed Sep. 24, 1996 pending.

This invention relates to an improved applicator and more particularly to an applicator for applying a liquid composition on a hard surface which may be allowed to dry and be buffed to provide a lustrous finish. The invention further contemplates an improved method of making such an applicator.

BACKGROUND OF THE INVENTION

In the care of floor surfaces in various commercial, governmental and industrial building facilities, it has been the conventional practice for janitorial personnel to periodically strip the floor surfaces in such facilities of a previously applied protective polish, apply several coats of a liquid polish, usually a polymer composition, allow the liquid polish to dry and then buff the dried polish to provide a lustrous, protective finish. Such floor surfaces typically consist of wooden, resilient tile, ceramic tile and even cement surfaces which are intended to be protected and provide an aesthetic and pleasing appearance. In applying the liquid polish, it further has been the conventional practice to use a wet-type or flat-type mop or applicator for uniformly spreading the liquid polish on the floor surface. Such polish must be uniformly spread and allowed to dry before the buffing operation. Usually, several coats of polish are applied and allowed to dry prior to the buffing operation. The buffing typically is performed by high speed machines equipped with rotary brushes which engage and buff a thin coat of dried polish to provide a lustrous finish.

Typically, wet-type or flat-type applicators used by janitorial personnel in spreading the liquid polish on floor surfaces essentially consist of a handle and a bundle or flat array of yarns attached to the handle. Such yarns traditionally have consisted of spun, natural staples or fibers of perhaps wool or cotton having individual lengths of up to six to seven inches.

When applicators of the type utilizing yarns of spun staples or fibers are used in spreading liquid polish on floor surfaces in the procedure as described, it has been found that breaks or voids occur in the finished, polished surface. It further has been found that such breaks or voids result from staples or fibers of spun yarn applicators breaking or tearing loose from applicator yarns and becoming entrapped in the dried coat of polish applied to the floor surface. Because of the often greater thickness of the staples or fibers than the thickness of the dried coat of polish on the floor surface, the high speed rotation of the buffing brushes will engage and strip away the exposed staples, leaving a break or void in the finished, polished coating on the floor surface. The stripping of such entrapped staples or fibers not only detracts from the aesthetic appearance of a lustrous floor surface but exposes the underlying floor material to the deleterious effects of scuffing and the elements.

It thus has been found to be desirable to provide an applicator for spreading a liquid polish on a floor surface which is to be allowed to dry and be buffed to a lustrous finish, in which components of the applicator will not break or tear loose during the use of the applicator in spreading the liquid polish on the floor surface and become entrapped in the dried polish, to be stripped away during the buffing operation and thus leave a break or void in the finished floor surface.

SUMMARY OF THE INVENTION

The present invention generally consists of an article for applying a liquid polish on a hard surface such as a floor surface of a building, which is allowed to dry and be buffed, usually by a high speed, rotary buffing machine utilizing one or more brushes, to provide a lustrous finish, comprising a handle, an applicator comprising a single strand of at least one continuous filament, initially laid in a winding pattern to provide a plurality of side-by-side segments with looped ends which then are severed to provide a plurality of free, loose ends, with means for securing the intermediate portions of the strand segments together, and means for attaching such applicator to such handle. In one embodiment of the invention, the applicator is formed in a bundle and secured to the handle by a conventional stirrup as in a wet-type mop or applicator. In another embodiment of the invention, the applicator is secured to a backing member which is adapted to be attached to a support member secured to a handle as in a flat-type mop or applicator.

DESCRIPTION OF EMBODIMENTS OF THE INVENTION

Figure 3:
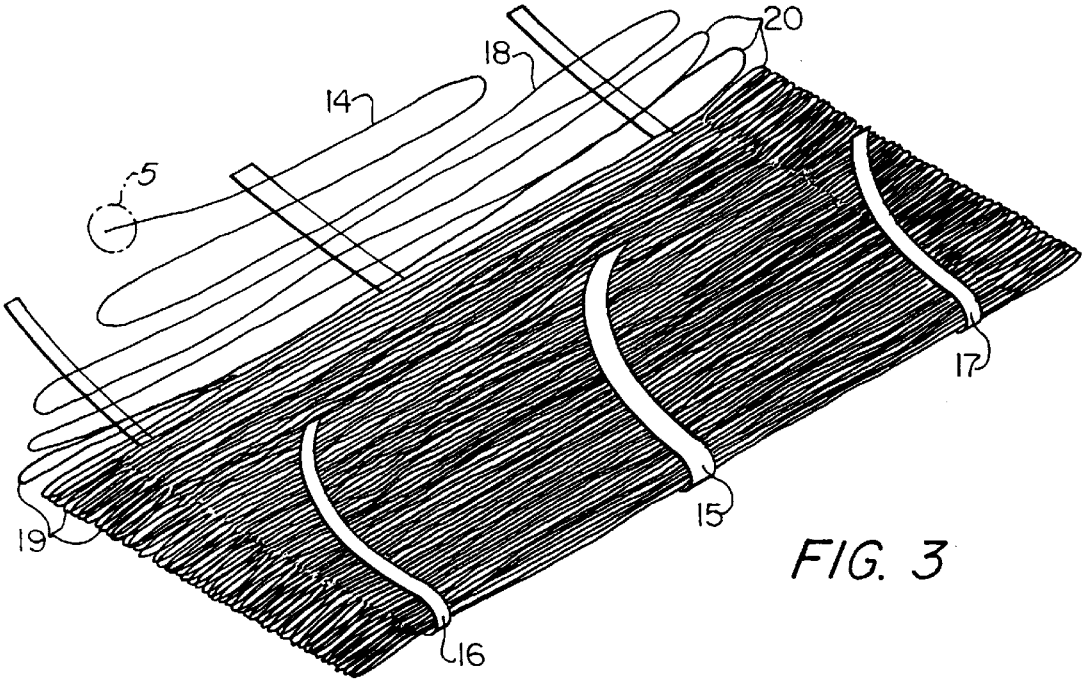
FIG. 3 is an enlarged, perspective view of the applicator used in the assembly shown in FIG. 1, detached from the handle and laid out in a flat condition.
Figure 4:
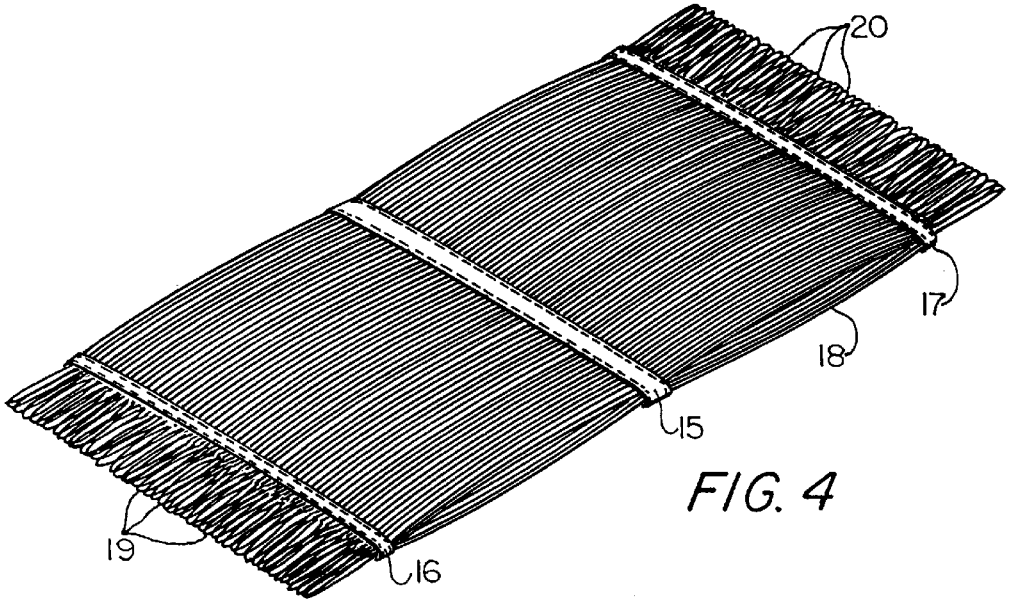
FIG. 4 is a view similar to the view shown in FIG. 3, illustrating the binding bands of the strand segments broken away and partially removed, and the pattern in which the single strand of the applicator is initially laid in the manufacture of the applicator.
Figure 5:
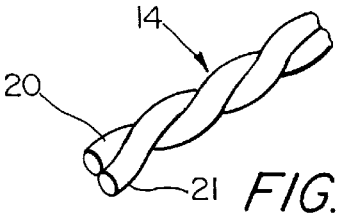
FIG. 5 is an enlargement of a portion of the single strand designated in FIG. 4, illustrating two continuous filaments intertwined.
Figure 6:
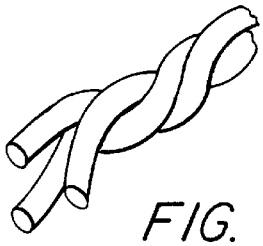
FIG. 6 is a view similar to the view shown in FIG. 5, illustrating a portion of a single strand utilizing three continuous filaments intertwined.

Referring to FIGS. 1 and 3 through 5 of the drawings, there is illustrated a wet-type mop or applicator assembly 10 embodying one version of the present invention which generally includes a handle 11, an applicator 12 and a stirrup 13 for detachably securing the applicator to the handle. The applicator is best shown in FIGS. 3 and 4 and consists of an initial single strand 14 secured together by a head band 15 and a pair of tail bands 16 and 17. Strand 14 is laid out in a winding pattern providing a plurality of side by side segments 18 having looped end portions 19 and 20. Head band 15 and tail bands 16 and 17 encompass strand segments 18 disposed in side by side relation, and are stitched together with portions of the strand segments interposed therebetween to provide a bundle of strand segments which are attached to the operating handle by means of the stirrup. After at least head band 15 is applied to secure strand segments 18 in side by side rotation, looped end portions 19 and 20 are severed to provide free, loose end portions 19*a* and 20*a*. Initial strand 14 may consist of a single continuous filament, two continuous filaments 20 and 21 intertwined as shown in FIG. 5 or a greater number of continuous filaments intertwined as shown in FIG. 6. Preferably, each of the continuous filaments is formed of a non-absorbent, synthetic material. Examples of suitable materials include nylon, polyamides, polyesters, polyacrylonitriles, polyvinyls, tetrafluorethylene, polyethylene, polypropylene, rayon, rayon acetate, rayon viscose and cellulose acetate. Bands 15, 16 and 17 may be formed of any suitable material and may be secured together with the strand segments interposed therebetween by any suitable means but preferably by stitching. Preferably, a head band and a pair of tail bands are provided for securing strand segments 18 together. A single head band, however, can also be used.

Figure 1:
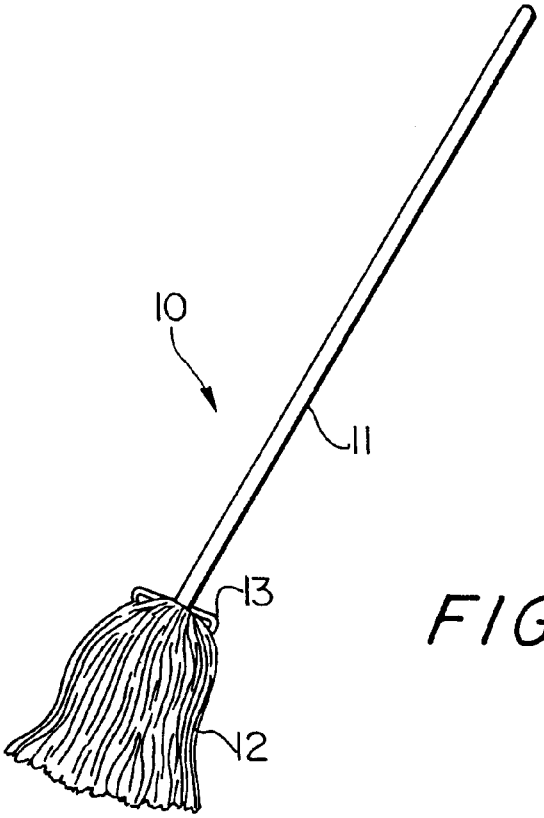
FIG. 1 is a perspective view of a wet-type mop or applicator embodying the present invention.

In the manufacture of the applicator as shown in FIGS. 3 through 5, band strips 15, 16, and 17 are first laid on a flat working surface with head band strip 15 disposed longitudinally in the middle and tail band strips 16 and 17 disposed longitudinally and spaced laterally to opposite sides of the head band strip. Beginning at one end, strand 14 consisting of either a single continuous filament, or two or more continuous filaments intertwined, is laid down across the band strips in a winding pattern so that intermediate strand segments 18 are disposed transversely relative to and overlie the band strips and the looped end portions thereof project laterally relative to the tail band strips. With strand segments 18 lying in side-by-side relation as shown in FIG. 4, the free ends of the band strips are folded up over the strand segments so that the band segments encompass the strand segments, and the strip segments overlying and underlying the strand segments are stitched together to provide the applicator as shown in FIG. 3 with portions of the strand segments securely interposed between the band strap segments and the looped end portions of the strand segments projecting laterally of head bands 16 and 17. The looped ends of segments 18 are then severed to provide a plurality of free, loose segment ends 19*a* and 20*a*. The applicator is then in a condition to be attached to a stirrup provided at the end of a handle to provide an assembly as shown in FIG. 1. In modifications of such embodiment, tail band strips 16 and 17 may be omitted providing only head band strip 15 for securing segments 18 together, and the head and tail band strips can be omitted with other means being used to secure segments 18 together and attach them to the end of the handle.

Figure 7:
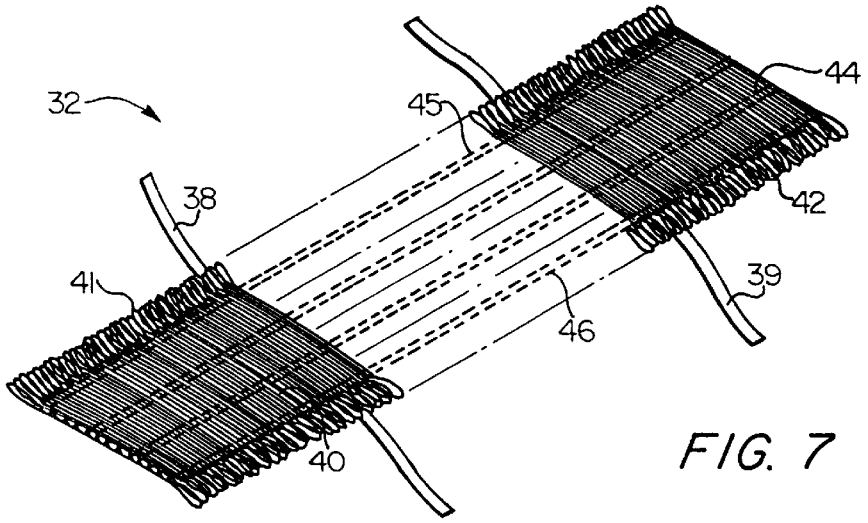
FIG. 7 is an enlarged, perspective bottom view of the applicator used in the assembly shown in FIG. 2.
Figure 8:
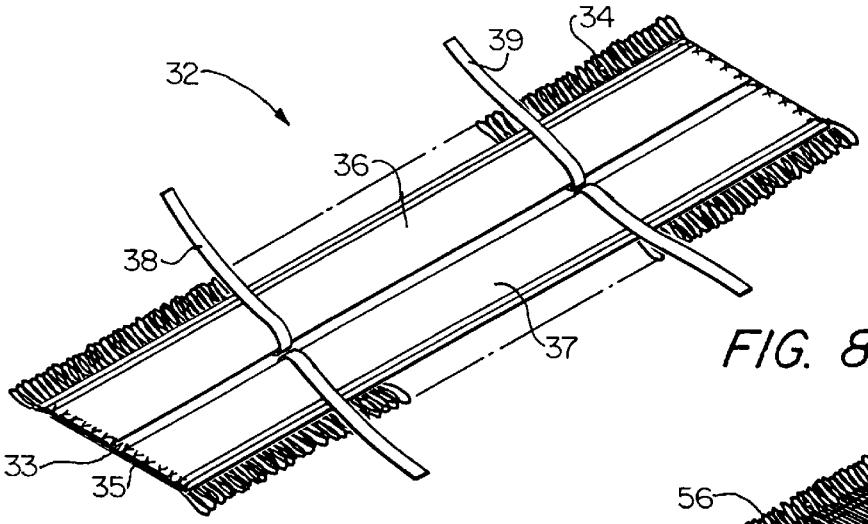
FIG. 8 is an enlarged, perspective top view of the applicator used in the assembly shown in FIG. 2.

Referring to FIGS. 2 and 7 through 9, there is shown a flat-type mop or applicator embodying a different embodiment of the invention which includes a handle 30 having a substantially rectangularly shaped, support panel member 31 secured at a free end thereof, and an applicator 32. As best shown in FIGS. 7 and 8, the applicator consists of a backing member 33 and initially a single strand 34 of at least one continuous filament. The backing member is adapted to receive support member 31 therein and consists of a bottom panel 35 adapted to underlie support member 31, a pair of upper panels 36 and 37 adapted to overlie support member 31, secured along the ends thereof to bottom panel 35 and providing a slit therebetween which may be enlarged to insert support member 31 therethrough when attaching the applicator on the support member, and through which handle 30 would extend, and two sets of ties 38 and 39 each of which may be tied together to maintain support member 31 within the backing member.

Similarly to strand 14, initial strand 34 is laid transversely across bottom panel 35 of the backing member in a winding pattern with intermediate strand segments 40 disposed in side-by-side relation along the longitudinal length of bottom panel 35, and looped end portions thereof initially extending laterally beyond the side edges of the bottom panel as shown in FIGS. 7 and 8. The strand segments are secured to bottom panel 35 by means of rows of stitches 43 and 44 and rows of stitches 45 and 46 which not only secure portions of strand segments 40 to bottom panel 35 but secure panels 36 and 37 in overlying relation relative to bottom panel 35. After strand segments 40 have been secured to bottom panel 35, the looped end portions are severed to provide free, loose end portions 41 and 42. As in the previously discussed embodiment, the continuous filament or intertwined continuous filaments forming strand 34 preferably are formed of a synthetic, non-absorbent material of the types previously described. The backing member may be formed of any sturdy, flexible material although it is preferred that such member be formed of a nonwoven material. The handle and support member attached thereto may be formed of a wood, plastic or metallic material.

Applicator 32 may be manufactured by first cutting a rectangular piece of backing material, preferably a nonwoven material, and placing it on a flat working surface. Strand 34 may then be laid on the back panel in a winding pattern forming strand segments 40 and the end loop portions thereof, with the strand segments disposed in side-by-side relation along the length of the bottom panel. The strand segments are then secured to the bottom panel by rows of stitches 43 and 44. After the ties are stitched to the inner sides of the material to form panels 36 and 37, the piece of material is inverted, the side portions of the piece of material are folded inwardly to the positions shown in FIG. 8 with the opposed edges thereof disposed in opposed relation to provide a slit therebetween, and upper panels 36 and 37, bottom panel 35 and outer portions of strand segments 40 are stitched together by rows of stitches, 45 and 46 and the end portions of panels 36 and 37 are stitched to the bottom panel to complete the applicator. The looped ends of segments 40 are then severed to provide a plurality of free, loose end portions 41 and 42 of segments 40. The completed applicator will thus have initial single strand 34 secured to the underside of bottom panel 35 in a plurality of strand segments 40 being disposed transversely relative to the bottom panel in side-by-side relation along the length of the bottom panel, with the looped end portions thereof having been severed and projecting laterally beyond the side edges of the bottom panel.

Figure 2:
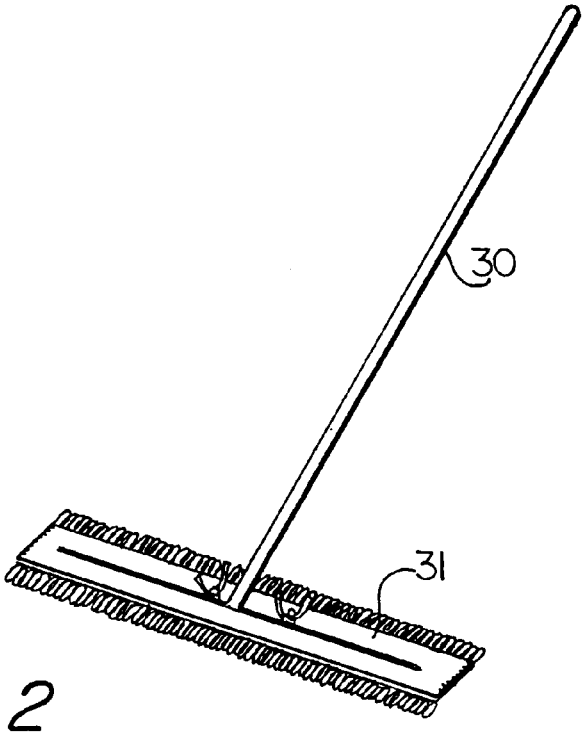
FIG. 2 is a perspective view of a flat-type mop or applicator embodying the present invention.

The applicator as shown in FIGS. 7 and 8 may be attached to handle 30 to provide a flat-type mop or applicator as shown in FIG. 2 simply by separating the inner sides of upper panels 36 and 37 to enlarge the slit therebetween, inserting support member 31 of the handle through the enlarged opening and into the pocket formed between the upper and lower panels of the backing member and simply tying the ties together to prevent the detachment of the applicator from the support member.

Figure 9:
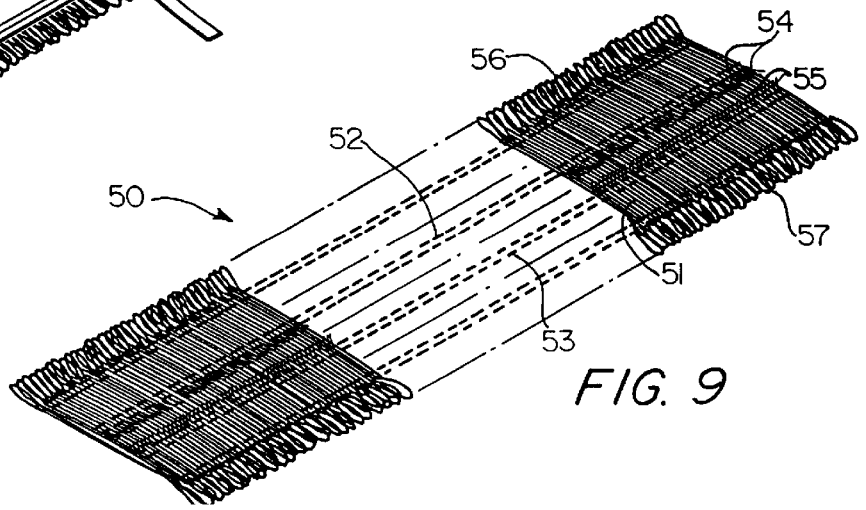
FIG. 9 is a view similar to the view shown in FIG. 7, illustrating a modification of the applicator.

FIG. 9 illustrates an applicator 50 which consists of a modification of the applicator shown in FIGS. 7 and 8. It is essentially identical to the applicator shown in FIGS. 7 and 8 except that strand segments 51 comparable to strand segments 40 are severed between rows of stitches 52 and 53 which provide a further plurality of free, loose end portions 54 and 55 of strand segments 51 disposed along the center of the applicator which have the effect of coacting with loose end portions 56 and 57 to provide an even more effective and uniform distribution of the liquid composition being spread by the use of the applicator assembly.

In any of the embodiments of the invention described, it will be appreciated that by the use of continuous filaments in the strands used to engage and spread the liquid composition being applied, no portions of such filaments will break or tear away from the applicator and become entrapped or embedded in the applied composition which could be dislodged by the brushing action of a buffer, leaving a break or void in the coating applied. Furthermore, it will be appreciated that by reason of the use of continuous filaments formed of a nonabsorbent material with a plurality of free, loose end portions, the liquid composition applied to the floor surface will be more easily and uniformly applied. In addition, it will be appreciated that by further severing the intermediate portions of the strand segments in the flat-type applicator as described, further terminal but firmly secured portions of the liquid composition spreading means is provided which results in an easier and more uniform application of the composition.

Additionally, the embodiments of the present invention may include a pair of bands overlying the strand segments and stitched to the backing member.

From the foregoing detailed description, it will be evident that there are a number of changes, adaptations and modifications of the present invention which come within the province of those having ordinary skill in the art to which the aforementioned invention pertains. However, it is intended that all such variations not departing from the spirit of the invention be considered as within the scope thereof as limited solely by the appended claims.

I claim:

1. An article for applying a liquid composition on a hard surface which may be allowed to dry and then buffed to provide a lustrous finish, comprising:

a handle;

an applicator comprising an initially provided single strand of at least one continuous filament of nonabsorbent material disposed in a winding pattern, providing a plurality of segments having previously formed looped end portions severed to provide a plurality of free, loose end portions, and means for securing said segments together; and means for securing said applicator to said handle.

2. An article according to claim 1 wherein said continuous filament comprises a synthetic material.

3. An article according to claim 1 wherein said continuous filament consists of a material selected from a group consisting of a nylon, polyamide, polyester, polyacrylonitrile, polyvinyl, tetrafluorethylene, polyethylene, polypropylene, rayon, rayon acetate, rayon viscose and cellulose acetate.

4. An article according to claim 1 wherein said strand consists of at least two continuous filaments intertwined.

5. An article according to claim 1 wherein said means for securing said segments together comprises at least one band encompassing said strand segments, having portions thereof stitched together with said strand segments interposed therebetween.

6. An article according to claim 5 wherein said means for securing said strand segments together further includes a band encompassing said strand segments between said at least one band and a set of free loose end portions of said strand segments, having portions thereof stitched together with said strand segments interposed therebetween.

7. An applicator attachable to a handle for applying a liquid composition on a hard surface which may be allowed to dry and then buffed to provide a lustrous finish, comprising:

an initially provided single strand of at least one continuous filament of nonabsorbent material disposed in a winding pattern, providing a plurality of segments having previously formed looped end portions disposed in side-by-side relation, severed to provide a plurality of free, loose end portions; and means for securing said segments together.

8. An applicator according to claim 7 wherein said continuous filament comprises a synthetic material.

9. An applicator according to claim 7 wherein said continuous filament consists of a material selected from a group consisting of a nylon, polyamide, polyester, polyacrylonitrile, polyvinyl, tetrafluorethylene, polyethylene, polypropylene, rayon, rayon acetate, rayon viscose and cellulose acetate.

10. An applicator according to claim 7 wherein said strand consists of at least two continuous filaments intertwined.

11. An applicator according to claim 7 wherein said means for securing said strand segments together comprises at least one band encompassing said strand segments, having portions thereof stitched together with said strand segments interposed therebetween.

12. An applicator according to claim 11 wherein said means for securing said strand segments together further includes a band encompassing said strand segments between said at least one band and a set of free, loose end portions of said segments, having portions thereof stitched together with said strand segments interposed therebetween.

13. An article for applying a liquid composition on a hard surface which may be allowed to dry and then buffed to provide a lustrous finish, comprising:

a handle having a support member attached thereto;

an applicator comprising a backing member disposed on said support member, an initially provided single strand of at least one continuous filament of nonabsorbent material disposed in a winding pattern on said backing member, providing a plurality of segments disposed in side-by-side relation and having previously provided looped end portions severed to provide a plurality of free, loose end portions, and means for securing said segments together; and means for securing said applicator to said handle with said backing member disposed on said support member.

14. An article according to claim 13 wherein said continuous filament comprises a synthetic material.

15. An article according to claim 13 wherein said continuous filament consists of a material selected from a group consisting of a nylon, polyamide, polyester, polyacrylonitrile, polyvinyl, tetrafluorethylene, polyethylene, polypropylene, rayon, rayon acetate, rayon viscose and cellulose acetate.

16. An article according to claim 13 wherein said strand consists of at least two continuous filaments intertwined.

17. An article according to claim 13 wherein said strand segments are severed intermediately the free, loose end portions thereof providing a plurality of free, loose intermediate portions of said strand segments disposed between said free, loose end portions.

18. An applicator attachable to a support member of a handle for applying a liquid composition on a hard surface which may be allowed to dry and then buffed to provide a lustrous finish, comprising:

a backing member disposable on said support member;

an initially provided single strand of at least one continuous filament of nonabsorbent material disposed in a winding pattern on said backing member, providing a plurality of segments disposed in side-by-side relation having previously formed looped end portions severed to provide a plurality of free, loose outer end portions;

means for securing said strand segments to said backing member; and means for securing said backing member with said strand segments secured thereto on said support member.

19. An applicator according to claim 18 wherein said continuous filament comprises a synthetic material.

20. An applicator according to claim 18 wherein said continuous filament consists of a material selected from a group consisting of a nylon, polyamide, polyester, polyacrylonitrile, polyvinyl, tetrafluorethylene, polyethylene, polypropylene, rayon, rayon acetate, rayon viscose and cellulose acetate.

21. An applicator according to claim 18 wherein said strand consists of at least two continuous filaments intertwined.

22. An applicator according to claim 18 wherein said means for securing said strand segments to said backing member comprises a pair of bands overlying said strand segments and stitched to said backing member.

23. An applicator according to claim 18 wherein said free, loose outer end portions of said strand segments extend beyond edge portions of backing member.

24. An applicator according to claim 18 wherein said backing member is formed of a nonwoven material.

25. An applicator according to claim 18 wherein said backing member includes a pocket in which said support member of said handle may be received to attach said applicator to said handle.

26. An applicator according to claim 25 including means for securing said support member in said pocket.

27. An applicator according to claim 18 wherein said backing member includes a bottom panel engageable with a first surface of said support member, a pair of upper panels having a pair of spaced, opposed edges providing a slit therebetween for inserting said support member therethrough for attaching said applicator to said handle, and secured to said bottom panel to provide a pocket for receiving said support member through an opening provided by separating said upper panels to enlarge the opening provided by said slit, and means for securing said upper panels together when said support member is received within said pocket.

28. An applicator according to claim 18 wherein said strand segments are severed intermediate their ends to provide a plurality of free, loose inner ends disposed between said free, loose outer end portions.

29. An applicator according to claim 28 wherein said means for securing said strand segments to said backing member comprises a pair of bands overlying said strand segments and stitched to said backing member, and wherein said strand segments are severed at points between said bands.

30. A method of making an applicator attachable to a handle for applying a liquid composition on a hard surface which may be allowed to dry and be buffed to provide a lustrous finish, comprising:

laying a strand consisting of at least one continuous filament of nonabsorbent material in a winding pattern providing a plurality of segments disposed in side-by-side relation having looped end portions;

securing at least one binding strip across said strand segments between said looped end portions; and severing said looped end portions to provide a plurality of free, loose end portions.

31. A method according to claim 30 wherein said binding strip consists of a band encompassing said strand segments, and wherein opposed portions of said band are secured together with portions of said strand segments interposed therebetween.

32. A method according to claim 30 including a first binding strip disposed between said free, loose end portions of said strand segments, and second and third binding strips, each disposed between said first binding strip and a set of looped end portions of said strand segments.

33. A method according to claim 32 wherein each of said binding strips consists of a band encompassing said strand segments, and wherein opposed portions of each of said bands are secured together with portions of said strand segments interposed therebetween.

34. A method according to claim 30 including laying said strand segments on a backing member connectable to a support member of said handle, and securing said binding strip to said backing member with said strand segments interposed therebetween.

35. A method according to claim 34 including severing said strand segments intermediate the free, loose end portions thereof.

36. A method according to claim 35 including providing a binding strip across each portion of said strand segments disposed between a set of inner severed end portions and a set of outer severed end portions of said strand segments.

37. A method according to claim 34 including providing means for attaching said backing member to said support member of said handle.

38. A method according to claim 30 wherein said continuous filament consists of a synthetic material.

39. A method according to claim 30 wherein said strand consists of at least two continuous filaments intertwined.

40. A method according to claim 34 wherein the lengths of said strand segments are formed of sufficient length so that free, loose end portions thereof extend beyond edges of said backing member.

41. An applicator attachable to a handle for applying a liquid composition on a hard surface made by the method consisting of:

laying a strand of at least one continuous filament of nonabsorbent material in a winding pattern providing a plurality of segments disposed in side-by-side relation having looped end portions;

securing intermediate portions of said segments together; and severing said looped end portions to provide a plurality of free, loose end portions of said segments.

42. An applicator made in accordance with claim 41 wherein the method includes laying said strand segments on a backing member attachable to a support member of said handle and securing intermediate portions of said segments to said backing member.

43. An applicator attachable to a handle for applying a liquid composition on a hard surface comprising:

a plurality of segments disposed in side-by-side relation, each of said segments consisting of a single filament of nonabsorbent material having free, loose end portions; and means for securing intermediate portions of said segments together.

44. An applicator according to claim 43 including a backing member and wherein said segments are secured to said backing member with the free, loose end portions thereof extending beyond edge portions of said backing member.

45. An applicator according to claim 44 wherein intermediate portions of said segments are severed providing a plurality of free, loose inner end portions.

* * * * *